US012584398B2

(12) United States Patent
Saponja et al.

(10) Patent No.: US 12,584,398 B2
(45) Date of Patent: Mar. 24, 2026

(54) DOWNHOLE SEPARATOR

(71) Applicant: Oilify New-tech Solutions Inc., Invermere (CA)

(72) Inventors: Jeffrey Charles Saponja, Invermere (CA); Robbie Singh Hari, Calgary (CA)

(73) Assignee: Oilify New-tech Solutions Inc., Invermere (CA)

( * ) Notice: Subject to any disclaimer, the term of this patent is extended or adjusted under 35 U.S.C. 154(b) by 0 days.

(21) Appl. No.: 18/936,482

(22) Filed: Nov. 4, 2024

(65) Prior Publication Data

US 2025/0146399 A1 May 8, 2025

Related U.S. Application Data

(60) Provisional application No. 63/596,098, filed on Nov. 3, 2023.

(51) Int. Cl.
*E21B 43/38* (2006.01)

(52) U.S. Cl.
CPC ..... *E21B 43/385* (2013.01)

(58) Field of Classification Search
CPC ..... E21B 43/38; E21B 43/121; E21B 43/385
See application file for complete search history.

(56) References Cited

U.S. PATENT DOCUMENTS

| | | | | |
|---|---|---|---|---|
| 1,662,296 | A | 3/1928 | Carlson | |
| 1,697,321 | A | 1/1929 | Marsh | |
| 2,549,706 | A | 4/1951 | Page | |
| 5,295,537 | A | 3/1994 | Trainer | |
| 6,039,121 | A | 3/2000 | Kisman | |
| 6,179,054 | B1 | 1/2001 | Stewart | |
| 6,719,048 | B1 | 4/2004 | Ramos | |
| 7,174,959 | B2 | 2/2007 | Pratt | |
| 7,377,314 | B2 | 5/2008 | Gonzalez | |
| 9,022,106 | B1 | 5/2015 | McCoy | |
| 9,765,608 | B2 | 9/2017 | Sims et al. | |
| 10,280,727 | B2 * | 5/2019 | Saponja | E21B 43/121 |
| 10,280,728 | B2 | 5/2019 | Boomer | |
| 10,689,949 | B2 * | 6/2020 | Saponja | E21B 21/002 |
| 12,006,810 | B2 * | 6/2024 | Saponja | E21B 43/121 |
| 2004/0119588 | A1 | 6/2004 | Marks | |
| 2007/0119588 | A1 | 5/2007 | Gonzales | |

(Continued)

FOREIGN PATENT DOCUMENTS

| | | |
|---|---|---|
| CA | 3050017 A1 | 7/2018 |
| CA | 3032720 A1 | 8/2019 |
| RU | 2269649 C2 | 2/2006 |

OTHER PUBLICATIONS

International Search Report and Written Opinion issued in International Application No. PCT/CA2021/050870, dated Aug. 27, 2021.

(Continued)

*Primary Examiner* — Aaron L Lembo
(74) *Attorney, Agent, or Firm* — Smart & Biggar LP

(57) ABSTRACT

There is provided a flow diverter for integration within a production string that is emplaced within a wellbore for effecting separation of reservoir fluid into gas-depleted reservoir fluid and gas-enriched reservoir fluid. The flow diverter is configured for, amongst other things, mitigating corrosion and erosion phenomena.

24 Claims, 14 Drawing Sheets

(56) References Cited

U.S. PATENT DOCUMENTS

| | | | | |
|---|---|---|---|---|
| 2016/0333681 | A1 | 11/2016 | Mazzanti | |
| 2017/0044888 | A1 | 2/2017 | Boomer | |
| 2018/0306019 | A1* | 10/2018 | Saponja ..... | B01D 19/00 |
| 2019/0292893 | A1 | 9/2019 | El-Mahbes et al. | |

OTHER PUBLICATIONS

International Preliminary Report on Patentability issued in International Application No. PCT/CA2021/050870, dated Dec. 13, 2022.

* cited by examiner

DOWNHOLE SEPARATOR

CROSS REFERENCE TO RELATED APPLICATION

The This application claims priority from U.S. Provisional Application No. 63/596,098, filed Nov. 3, 2023, entitled DOWNHOLE SEPARATOR, the contents of which are incorporated by reference herein in their entirety.

FIELD

The present disclosure relates to mitigating gas interference with downhole pump operation during hydrocarbon production.

BACKGROUND

Reservoir fluids often contain entrained gases and solids. In producing reservoir fluids containing a relatively substantial fraction of gaseous material, the presence of such gaseous material hinders production by contributing to sluggish flow, and interfering with pump operation. As well, the presence of solids interferes with pump operation, including contributing to erosion of mechanical components.

Separators are provided to help remedy or mitigate downhole pump gas interference during hydrocarbon production. However, separators often occupy relatively significant amounts of space within a wellbore, rendering efficient separation of gaseous material that is entrained within the reservoir fluid difficult. Some separators are complex structures and are associated with increased material and manufacturing costs. Accordingly, efficient and cost-effective separation of gaseous material that is entrained within the reservoir fluid is desirable.

SUMMARY

In one aspect, there is provided a system comprising a flow diverter, emplaced within a wellbore string passage of a wellbore string that is lining a wellbore through which reservoir fluid is producible from a hydrocarbon reservoir within a subterranean formation, wherein: the flow diverter and the wellbore string are co-operatively configured such that, in response to inducement by the pump: while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the flow diverter diverts the downwardly-flowing gas-depleted reservoir fluid such that the downwardly-flowing gas-depleted reservoir fluid changes direction and an upwardly-flowing gas-depleted reservoir fluid, being conducted by a flow diverting conductor configuration, is established, wherein the flow diverter includes the flow diverting conductor configuration; wherein: the flow diverting conductor configuration includes a plurality of flow diverting conductor branches, wherein: each one of the flow diverting conductor branches, independently, includes a respective branch inlet configuration, defined by at least one port, in flow communication with the gas separation zone with effect that the established upwardly-flowing gas-depleted reservoir fluid is distributed amongst the flow diverting conductor branches, such that: the plurality of flow diverting conductor branches defines a plurality of branch inlet configurations; and for each one of the flow diverting conductor branches, a portion of the upwardly-flowing gas-depleted reservoir fluid is established within the flow diverting conductor branch.

In another aspect, there is provided a system for producing reservoir fluid from a hydrocarbon reservoir within a subterranean formation via a wellbore string passage of a wellbore string that is lining a wellbore that is extending into the subterranean formation, comprising: a pump; and a flow diverter, emplaced within the wellbore string passage, including: a diverter inlet configuration, defined by at least one port; a diverter cavity; and a flow diverting conductor configuration defining a flow passage configuration; wherein: fluid coupling between the diverter cavity and the suction of the pump is effected via the flow passage configuration of the flow diverting conductor configuration only; the flow diverter and the wellbore string are co-operatively configured such that, in response to inducement by the pump: while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the diverter cavity receives the downwardly-flowing gas-depleted reservoir fluid, via the diverter inlet configuration, with effect that the downwardly-flowing gas-depleted reservoir fluid becomes disposed within the diverter cavity; and the flow diverter diverts the received downwardly-flowing gas-depleted reservoir fluid such that the downwardly-flowing gas-depleted reservoir fluid changes direction and an upwardly-flowing gas-depleted reservoir fluid, being conducted by the flow diverting conductor configuration, is established, and supplied to the pump; wherein: there is an absence of alignment between a central longitudinal axis, of a portion of the flow passage configuration of the flow diverting conductor configuration, with a central longitudinal axis of a flow passage of a pump suction of the pump; and there is an absence of a bend, within the flow passage configuration of the flow diverting conductor configuration, that is greater than ten (10) degrees.

In another aspect, there is provided a system for producing reservoir fluid from a hydrocarbon reservoir within a subterranean formation via a wellbore string passage of a wellbore string that is lining a wellbore that is extending into the subterranean formation, comprising: a flow diverter, emplaced within the wellbore string passage, including: a cavity-defining housing; a cavity defined within the cavity-defining housing; and a flow diverting conductor extending into the cavity such that a cavity-disposed portion of the flow diverting conductor is disposed within the cavity; wherein: the cavity-disposed portion of the flow diverting conductor includes: a flow passage-defining housing which defines a flow passage; and a plurality of vanes, such that the flow diverting conductor includes a vane configuration disposed within the cavity; wherein: each one of the vanes, independently, extends from the flow passage-defining housing, in a laterally outwardly direction relative to the central longitudinal axis of the flow passage; the flow diverter and the wellbore string are co-operatively configured such that, in response to inducement by a pump: while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the cavity receives the downwardly-flowing gas-depleted reservoir fluid with effect that the downwardly-flowing gas-depleted reservoir fluid is conducted past the vane configuration with effect that a torsional flow component is imparted to the downwardly-flowing gas-depleted reservoir fluid by the vane configuration, such that separation of solid particulate material, from the downwardly-flowing gas-depleted reservoir fluid, is induced; and the flow diverter diverts the downwardly-flowing gas-depleted reservoir fluid such that the downwardly-flowing gas-depleted reservoir fluid changes direction and an upwardly-flowing gas-depleted reservoir fluid, being conducted by the flow diverting conductor, is established; and relative to one another, the vanes are circumferentially staggered and axially staggered.

In another aspect, there is provided a system for producing reservoir fluid from a hydrocarbon reservoir within a subterranean formation via a wellbore string passage of a wellbore string that is lining a wellbore that is extending into the subterranean formation, comprising: a flow diverter, emplaced within the wellbore string passage, including: a housing, wherein the housing includes a base and a continuous sidewall, extending upwardly from the base, and the base and the continuous sidewall co-operate to define the cavity; a flow diverting conductor; wherein: the flow diverter and the wellbore string are co-operatively configured such that, in response to inducement by a pump: while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the cavity receives the downwardly-flowing gas-depleted reservoir fluid with effect that the downwardly-flowing gas-depleted reservoir fluid is conducted past the vane configuration with effect that a torsional flow component is imparted to the downwardly-flowing gas-depleted reservoir fluid by the vane configuration, such that separation of solid particulate material, from the downwardly-flowing gas-depleted reservoir fluid, is induced; and the flow diverter diverts the downwardly-flowing gas-depleted reservoir fluid such that the downwardly-flowing gas-depleted reservoir fluid changes direction and an upwardly-flowing gas-depleted reservoir fluid, being conducted by the flow diverting conductor, is established; and the continuous sidewall, of the housing, includes a slotted cylindrical portion, defining a slot extending downwardly from an upper edge of the housing, and within which is emplaced a lower portion of the flow diverting conductor, such that the slot is sealed by the lower portion of the flow diverting conductor, and such that at least the slotted cylindrical portion and the lower portion, of the flow diverting conductor, co-operate to define the sidewall.

Other aspects will be apparent from the description and drawings provided herein.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
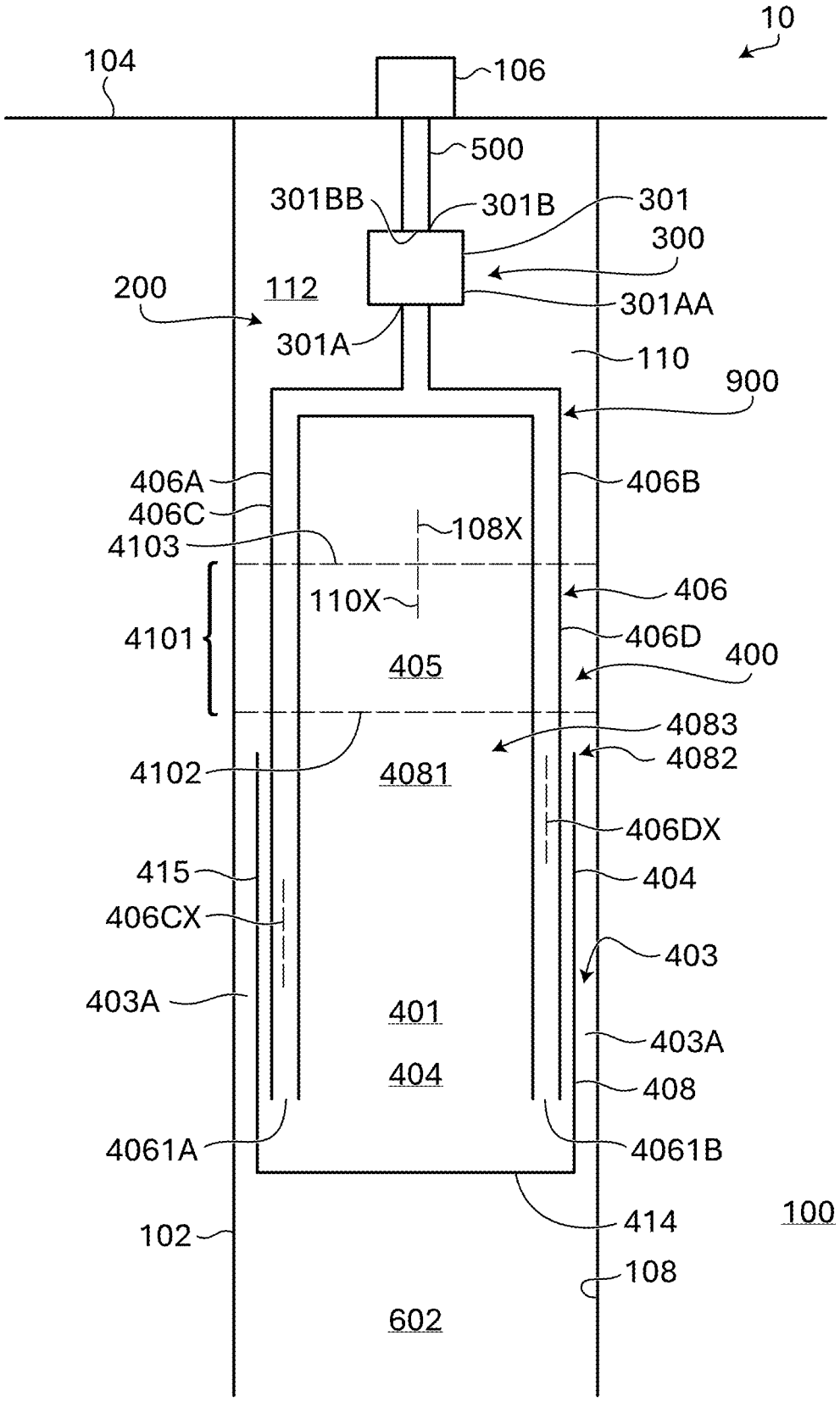
FIG. 1 is a schematic illustration of an embodiment of a system of the present disclosure.
Figure 2:
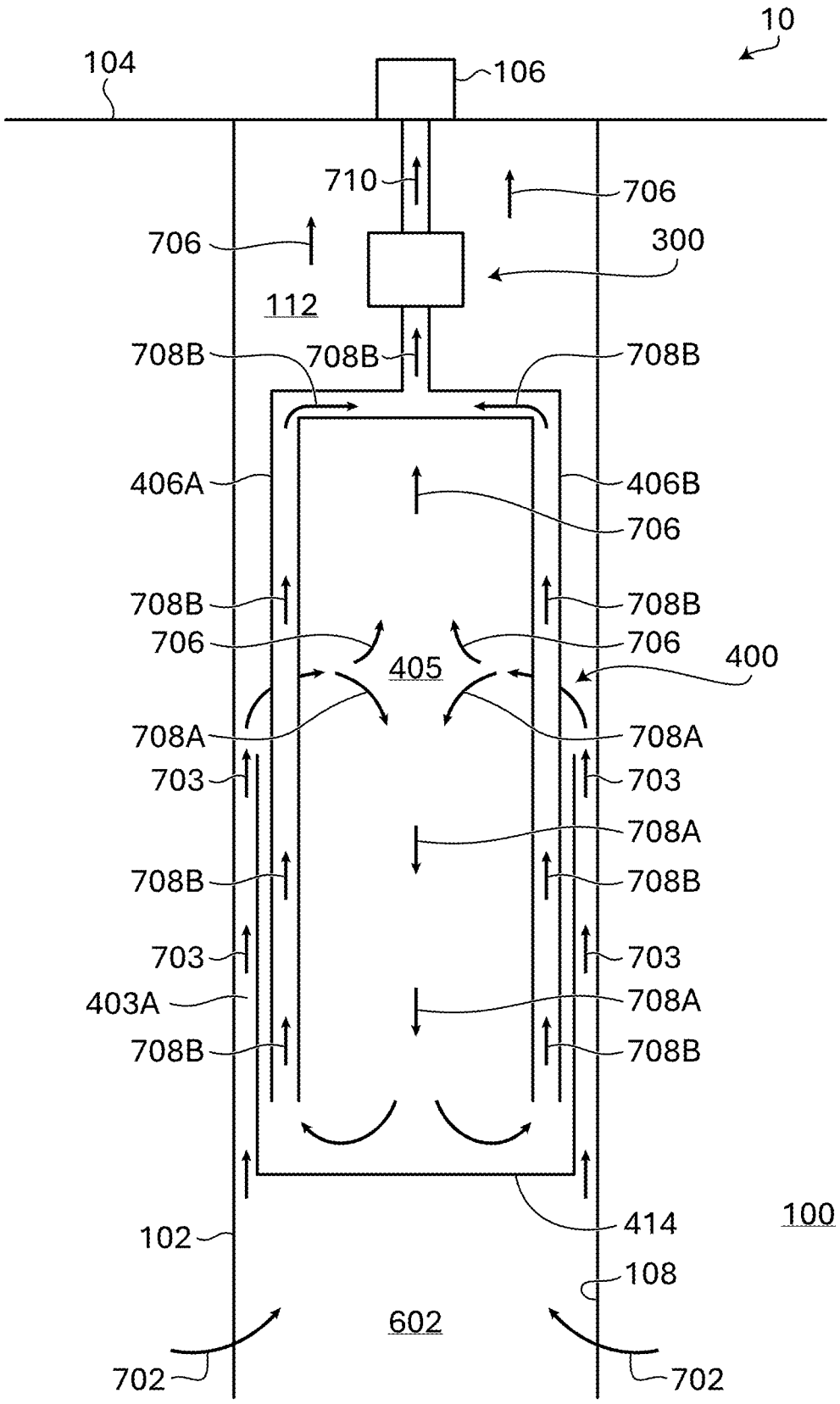
FIG. 2 is identical to FIG. 1, and illustrates the flow direction of fluids during implementation of a process via the embodiment of the system.

Referring to FIGS. 1 to 22, there are provided systems 10 for producing hydrocarbon material from an oil reservoir within a subterranean formation 100.

A wellbore 102 of a subterranean formation can be straight, curved or branched. The wellbore can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. In some embodiments, for example, the central longitudinal axis of the passage of a horizontal section is disposed along an axis that is between about 70 and about 110 degrees relative to the vertical, while the central longitudinal axis of the passage of a vertical section is disposed along an axis that is less than about 20 degrees from the vertical "V", and a transition section is disposed between the horizontal and vertical sections.

"Reservoir fluid" is fluid that is contained within an oil reservoir. Reservoir fluid includes a mixture of liquid material and gaseous material, and also includes, optionally, entrained solid particulate material. The reservoir fluid includes hydrocarbon material, such as oil, natural gas condensates, or any combination thereof. The reservoir fluid can also contain water. The reservoir fluid can also include fluids injected into the reservoir for effecting stimulation of resident fluids within the reservoir.

The term "fluid conductor configuration" refers to a configuration which conducts fluid. The configuration can be: (a) a single conductor, (b) a plurality of parallel conductors, (c) a network of interconnected conductors, or any combination of (a), (b), and (c).

A wellbore string 108 is emplaced within the wellbore 102 for stabilizing the subterranean formation 100. In some embodiments, for example, the wellbore string 108 also contributes to effecting fluidic isolation of one zone within the subterranean formation 100 from another zone within the subterranean formation 100.

The fluid productive portion of the wellbore 102 may be completed either as a cased-hole completion or an open-hole completion.

With respect to a cased-hole completion, in some embodiments, for example, a wellbore string 108, in the form of a wellbore casing that includes one or more casing strings, each of which is positioned within the wellbore 102, having one end extending from the wellhead 106, is provided. In some embodiments, for example, each casing string is defined by jointed segments of pipe. The jointed segments of pipe typically have threaded connections.

Typically, a wellbore 102 contains multiple intervals of concentric casing strings, successively deployed within the previously run casing. With the exception of a liner string, casing strings typically run back up to the surface 104. Typically, casing string sizes are intentionally minimized to minimize costs during well construction. Generally, smaller casing sizes make production and artificial lifting more challenging.

For wells that are used for producing reservoir fluid, few of these actually produce through the wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 106. In some embodiments, for example, the annular region between the last casing string and the production string may be sealed at the bottom by a packer.

The wellbore 102 is disposed in flow communication (such as through perforations provided within the installed casing or liner, or by virtue of the open hole configuration of the completion), or is selectively disposable into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 10 receives the reservoir fluid.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 106. Cement may be provided within the annular region between the liner string and the oil reservoir for effecting zonal isolation (see below), but is not in all cases. In some embodiments, for example, this liner is perforated to effect flow communication between the reservoir and the wellbore. In some embodiments, for example, the production tubing string may be engaged or stung into the liner string, thereby providing a fluid passage for conducting the produced reservoir fluid to the wellhead 106.

An open-hole completion is established by drilling down to the producing formation, and then lining the wellbore (such as, for example, with a wellbore string 108). The wellbore is then drilled through the producing formation, and the bottom of the wellbore is left open (i.e. uncased), to effect flow communication between the reservoir and the wellbore.

The system 10 receives, via the wellbore 102, the reservoir fluid flow from the subterranean formation 100. As discussed above, the wellbore 102 is disposed in flow communication (such as through perforations provided within the installed casing or liner, or by virtue of the open hole configuration of the completion), or is selectively manipulated into flow communication (such as by perforating the installed casing, or by actuating a valve to effect opening of a port), with the subterranean formation 100. When disposed in flow communication with the subterranean formation 100, the wellbore 102 is disposed for receiving reservoir fluid flow from the subterranean formation 100, with effect that the system 10 receives the reservoir fluid.

In some embodiments, for example, the system 10 includes a production string, including a reservoir fluid production assembly 200, disposed within a wellbore string passage 110 of the wellbore string 108. The reservoir production assembly 200 includes a flow diverter 400 and a pumping assembly 300.

The pumping assembly 300 includes a pump 301 and a pressurized gas-depleted reservoir flow conductor 500. The pump 301 includes a suction 301A (or "intake") and a discharge 301B. The flow diverter 400 is fluidly coupled to the pump suction 301A. The pressurized gas-depleted reservoir flow conductor 500 is fluidly coupled to the pump discharge 301B. In some embodiments, for example, the suction 301A defines a pump suction flow passage 301AA, and the central longitudinal axis 301X of the pump suction flow passage 301AA is aligned with the central longitudinal axis 110X of the wellbore string passage 110.

In some embodiments, for example, the pump 301 is a rod pump 301. The rod pump 301 includes a conveyor, such as a rod or a rod string, extending through the pressurized gas-depleted reservoir fluid conductor 500, and connected to surface equipment which causes reciprocating movement of the conveyor. In some embodiments, for example, the surface equipment includes a prime mover (e.g. an internal combustion engine or a motor), a crank arm, and a beam. The prime mover rotates the crank arm, and the rotational movement of the crank arm is converted to reciprocal longitudinal movement through the beam. In some embodiments, for example, the prime mover is a pumpjack. The beam is attached to a polished rod by cables hung from a horsehead at the end of the beam. The polished rod passes through a stuffing box and is attached to the conveyor. Accordingly, the surface equipment effects reciprocating longitudinal movement of the conveyor, and further defines the upper and lower displacement limits of the conveyor. Reservoir fluid is produced to the surface in response to reciprocating longitudinal movement of the rod by the pumpjack.

A reservoir fluid-receiving zone 602 is disposed within the wellbore string passage 110 for receiving reservoir fluid flow 702 that is conducted from the subterranean formation 100 and into the wellbore 102. In this respect, reservoir fluid flow 702, from the subterranean formation 100, is received by the reservoir fluid-receiving zone 602. In some embodiments, for example, the reservoir fluid-receiving zone 602 is disposed within a horizontal section of the wellbore 102.

A flow diverter 400 co-operates with the wellbore string 108 to define a separator for effecting separation of the reservoir fluid into a gas-depleted reservoir fluid and a gas-enriched reservoir fluid in response to buoyancy forces.

In this respect, the flow diverter 400 and the wellbore string 108 are co-operatively configured such that, in response to inducement by the pump 301:

- while reservoir fluid 702 is disposed within a reservoir fluid-receiving zone 602, disposed within the wellbore string passage, the reservoir fluid is conducted upwardly (as flow 703) to a gas separation zone 405 (such as, for example, via an upwardly-conducting reservoir fluid conductor configuration 403), disposed within the wellbore string passage 110 such that the reservoir fluid
- becomes emplaced within the gas separation zone 405, with effect that the reservoir fluid flow is separated into at least a downwardly-flowing gas-depleted reservoir fluid 708A and an upwardly flowing gas-enriched reservoir fluid 706, wherein the separation includes separation in response to buoyancy forces within the gas separation zone 405; and
- while the separated gas-depleted reservoir fluid 708A is flowing downwardly from the separation zone 405, the flow diverter 400 diverts the downwardly-flowing gas-depleted reservoir fluid 708A such that the downwardly-flowing gas-depleted reservoir fluid 708A changes direction and an upwardly-flowing gas-depleted reservoir fluid 708B, being conducted by a flow diverting conductor configuration 406, is established, wherein the flow diverter 400 includes the flow diverting conductor configuration 406.

In some embodiments, for example, the flow diverter 400 includes a collector 408. In some embodiments, for example, the collector 408 includes a base 414 (defining a closed lower end) and a continuous sidewall 415, extending upwardly from the base 414, and the base 414 and the continuous sidewall 415 co-operate to define the cavity 401. In some embodiments, for example, the reservoir fluid conductor configuration 403 is defined by an annular space 403A between the collector 408 (such as, for example, the continuous sidewall 415 of the collector 408) and the wellbore string 108. In this respect, while reservoir fluid flow 702 is being received within a reservoir fluid-receiving zone 602, of the wellbore string passage 110, from the subterranean formation 100, the reservoir fluid flow 702 is conducted upwardly to the gas separation zone 405 via the annular space 403A, with effect that the reservoir fluid flow becomes emplaced within the separation zone 405.

In some embodiments, for example, the gas separation zone 405 is occupied by the reservoir fluid only. In some embodiments, for example, there is an absence of a downhole completion (such as, for example, an absence of the flow diverting conductor configuration 406 within the gas separation zone 405).

The gas separation zone 405 has a sufficiently large cross-sectional flow area, relative to that of the upwardly-conducting reservoir fluid conductor configuration 403 through which the reservoir fluid-derived flow is conducted from the receiving zone 602, with effect that the flowrate of the reservoir fluid flow 702 is sufficiently reduced so as to promote the separation.

In some embodiments, for example, the separation zone 405 extends from a lower wellbore string passage cross-section 4102, of the wellbore string passage 410, to an upper wellbore string passage cross-section 4103, of the wellbore string passage 410, such that a separation zone-defining wellbore string passage section 4101, of the wellbore string passage 410, is defined and extends from the lower wellbore string passage cross-section 4102, of the wellbore string passage 410, to the upper wellbore string passage cross-section 4103, of the wellbore string passage 410. In this respect, the separation zone 405 is defined within the separation zone-defining wellbore string passage section 4101.

In some embodiments, for example, the gas separation zone 405 is disposed within a passage of the wellbore 102 whose central longitudinal is disposed along an axis that is disposed at an acute angle of less than about 45 degrees from the vertical "V", such as, for example, less than about 35 degrees from the vertical "V".

In some embodiments, for example, the flow diverter 400 includes a diverter cavity 401 for collecting the downwardly-flowing gas-depleted reservoir fluid. The collection of the gas-depleted reservoir fluid is effected by preventing the downwardly-flowing gas-depleted reservoir fluid from bypassing the flow diverting conductor configuration 406.

In this respect, in some embodiments, for example, the flow diverter 400 includes a diverter inlet configuration 4081 that is defined by one or more ports (in the embodiment illustrated in FIGS. 1 to 3, and 8, the diverter inlet configuration 4081 is defined by a single aperture). In some embodiments, for example, the diverter inlet configuration 4081 is oriented in an uphole facing direction. In some embodiments, for example, the axis of the diverter inlet configuration 4081 is parallel to the central longitudinal axis 108X of the wellbore string 108. Flow communication between the flow diverting conductor configuration 406 and the separation zone 405 is effected via the diverter inlet configuration 4081 only. The diverter inlet configuration 4081 is disposed below the separation zone 405, such that the diverter inlet configuration 4081 is disposed for receiving the downwardly-flowing gas-depleted reservoir fluid. In some embodiments, for example, the downwardly-flowing gas-depleted reservoir fluid, being received by the collector inlet configuration 4081, continues to be depleted in gaseous material before becoming diverted by the flow diverter 400 such that the upwardly-flowing gas-depleted reservoir fluid is obtained. In this respect, in some embodiments, for example, the gas separation zone 405 extends into the cavity 401. In some embodiment, for example, the flow diverting conductor configuration 406 defines a diverting conductor inlet configuration 4061 in flow communication with the diverter inlet configuration 4081 for receiving the downwardly-flowing gas-depleted reservoir fluid being received by the diverter inlet configuration 4081.

In some embodiments, for example, the flow diverting conductor configuration 406 extends into the cavity 401 via an opening 4083 defined at an upper end 4082 of the housing. In some embodiments, for example, the diverter inlet configuration 4081 is defined by the space of the opening 4083 that is unoccupied by the flow diverting conductor configuration 406. In some embodiments, for example, the cavity 401 and at least the flow diverting conductor configuration 406 co-operate to define, within the cavity 401, a collection space 404 for collecting the gas-depleted reservoir fluid that has been received by the diverter inlet configuration 4081. In some embodiments, for example, the established upwardly-flowing gas-depleted reservoir fluid 708B, being conducted by the flow diverting conductor configuration 406, is obtained by the diverting of the gas-depleted reservoir fluid that becomes emplaced within the collection space 404.

Referring to FIGS. 1 to 3, and 7, in some embodiments, for example, the flow diverting conductor configuration 406 includes a plurality of flow diverting conductor branches 406A, 406B (the illustrated embodiment includes two such branches). In some embodiments, for example, the flow diverter 400 is mounted to the branches 406A, 406B, such that the branches 406A, 406B are sufficiently strong to structurally support the flow diverter 400. In this respect, in some of these embodiments, the material of construction of the branches 406A, 406B is carbon steel. In some embodiments, for example, the branches 406A, 406B are coupled to one another via gusset braces for bracing the structure that includes the branches 406A, 406B and the flow diverter 400.

Each one of the flow diverting conductor branches 406A, 406B, independently, is configured for conducting a respective gas-depleted reservoir fluid portion in an upwardly direction, such that the conducting of the upwardly flowing gas-depleted reservoir fluid 708B, by the flow diverting conductor configuration 406, includes (and, in some embodiments, for example, is defined by) the conducting of the gas-depleted reservoir fluid portions by the flow diverting conductor branches 406A, 406B. In some embodiments, for example, for each one of the flow diverting conductor branches 406A, 406B, independently, the conducting, of the respective gas-depleted reservoir fluid portion in an upwardly direction, is with effect that the upwardly-flowing gas-depleted reservoir fluid portion becomes emplaced above the separation zone 405.

The plurality of flow diverting conductor branches 406A, 406B are joined together for supplying a combined flow, that is defined by the gas-depleted reservoir fluid portions being conducted by the flow diverting conductor branches 406A, 406B, to the suction 301A of the pump 301 (in some of these embodiments, for example, the combined flow is the gas-depleted reservoir fluid 708B that is supplied to the suction 301A of the pump 301).

For each one of the flow diverting conductor branches 406A, 406B, independently, at least a portion of the flow diverting conductor branch 406A, 406B is defined by a respective eccentrically-disposed gas-depleted fluid conductor sections 406C, 406D, such that a plurality of eccentrically-disposed gas-depleted fluid conductor sections 406C, 406D is defined for establishing an eccentrically-disposed gas-depleted fluid conductor configuration. Each one of the eccentrically-disposed gas-depleted fluid conductor sections 406C, 406D, independently, is disposed eccentrically relative to the central longitudinal axis 110X of the wellbore string passage 110. In this respect, for each one of the eccentrically-disposed gas-depleted fluid conductor sections 406C, 406D, independently, there is an absence of alignment between the central longitudinal axis of the flow passage of the conductor section 406C (406D) and the central longitudinal axis 110X of the wellbore string passage 110.

Each one of the eccentrically-disposed gas-depleted fluid conductor sections 406C, 406D, independently, extends at least across the separation zone-defining wellbore passage section 4101 of the wellbore string passage 110. In this respect, for each one of the eccentrically-disposed gas-depleted fluid conductor sections 406C, 406D, independently, at least a portion of the eccentrically-disposed gas-depleted fluid conductor section 406C, 406D extends across the separation zone-defining wellbore passage section 4101.

For each one of the eccentrically-disposed gas-depleted fluid conductor sections 406C, 406D, independently, the eccentrically-disposed gas-depleted fluid conductor section 406C (406D) defines a flow passage with a central longitudinal axis 406CX (406DX), and there is an absence of alignment between the central longitudinal axis 406CX (406DX) of the eccentrically-disposed gas-depleted fluid conductor section 406C (406D) and the central longitudinal axis 301X of the pump suction fluid passage. In some embodiments, for example, the minimum distance between the central longitudinal axis 406CX (406DX) of the eccentrically-disposed gas-depleted fluid conductor section 406C (406D) and the central longitudinal axis 301X of the pump suction fluid passage 301AA is greater than one (1) inch, such as, for example, greater than 1.25 inch.

Figure 3:
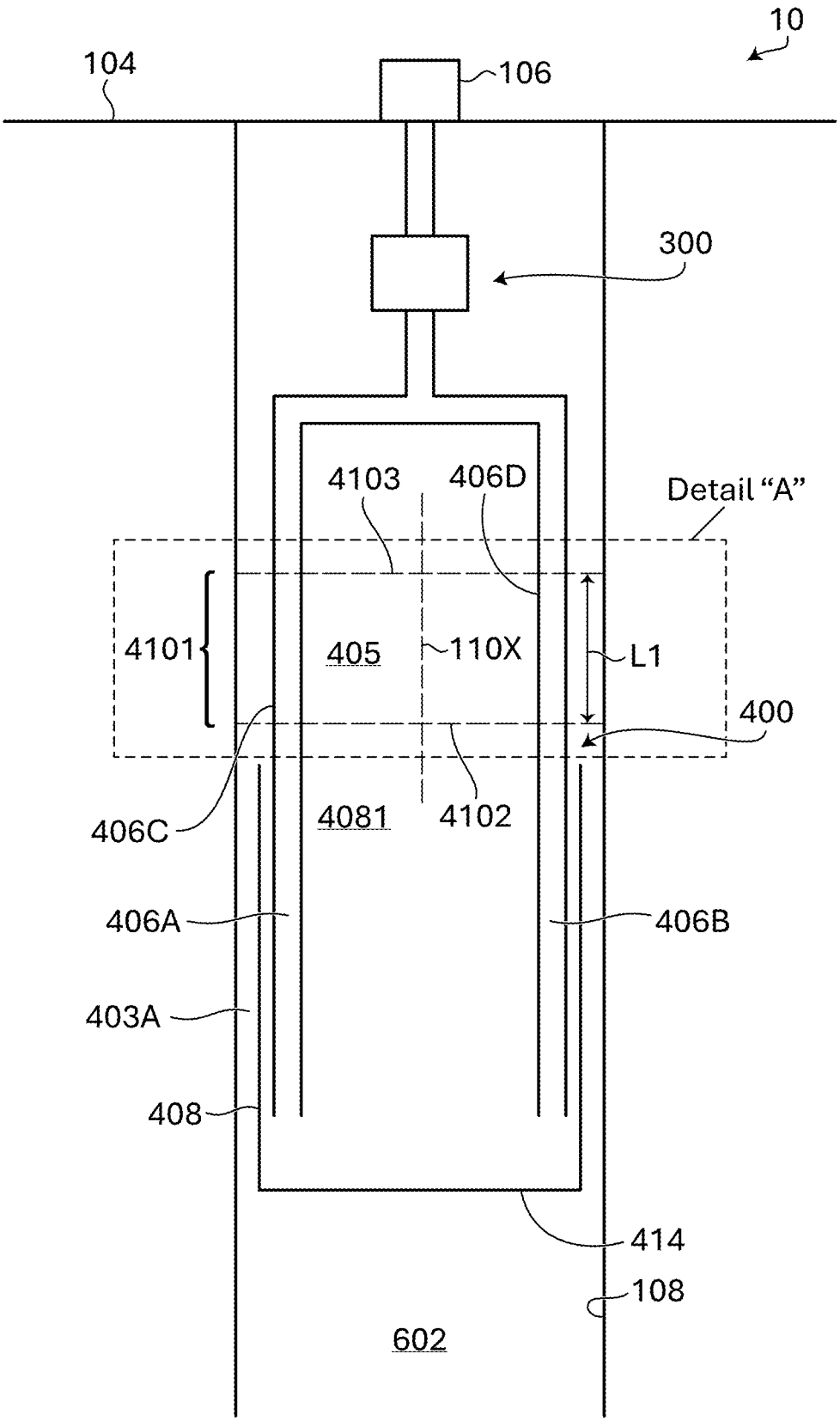
FIG. 3 is identical to FIG. 1, and further identifies features of the embodiment of the system.

Referring to FIG. 3, in some embodiments, for example, each one of eccentrically-disposed gas-depleted fluid conductor sections 406C, 406D, independently, has a total length "L1" of at least three (3) feet, as measured along the central longitudinal axis of the eccentrically-disposed gas-depleted fluid conductor section. In some embodiments, for example, each one of the eccentrically-disposed gas-depleted fluid conductor sections 406C, 406D, independently, has a total length "L1" of at least six (6) feet. In some embodiments, for example, each one of the eccentrically-disposed gas-depleted fluid conductor sections 406C, 406D, independently, has a total length "L1" of at least 15 feet. In some embodiments, for example, each one of the eccentrically-disposed gas-depleted fluid conductor sections 406C, 406D, independently, has a total length "L1" of at least 20 feet. In some embodiments, for example, each one of the eccentrically-disposed gas-depleted fluid conductor sections 406C, 406D, independently, has a total length "L1" of at least 30 feet.

Figure 4:
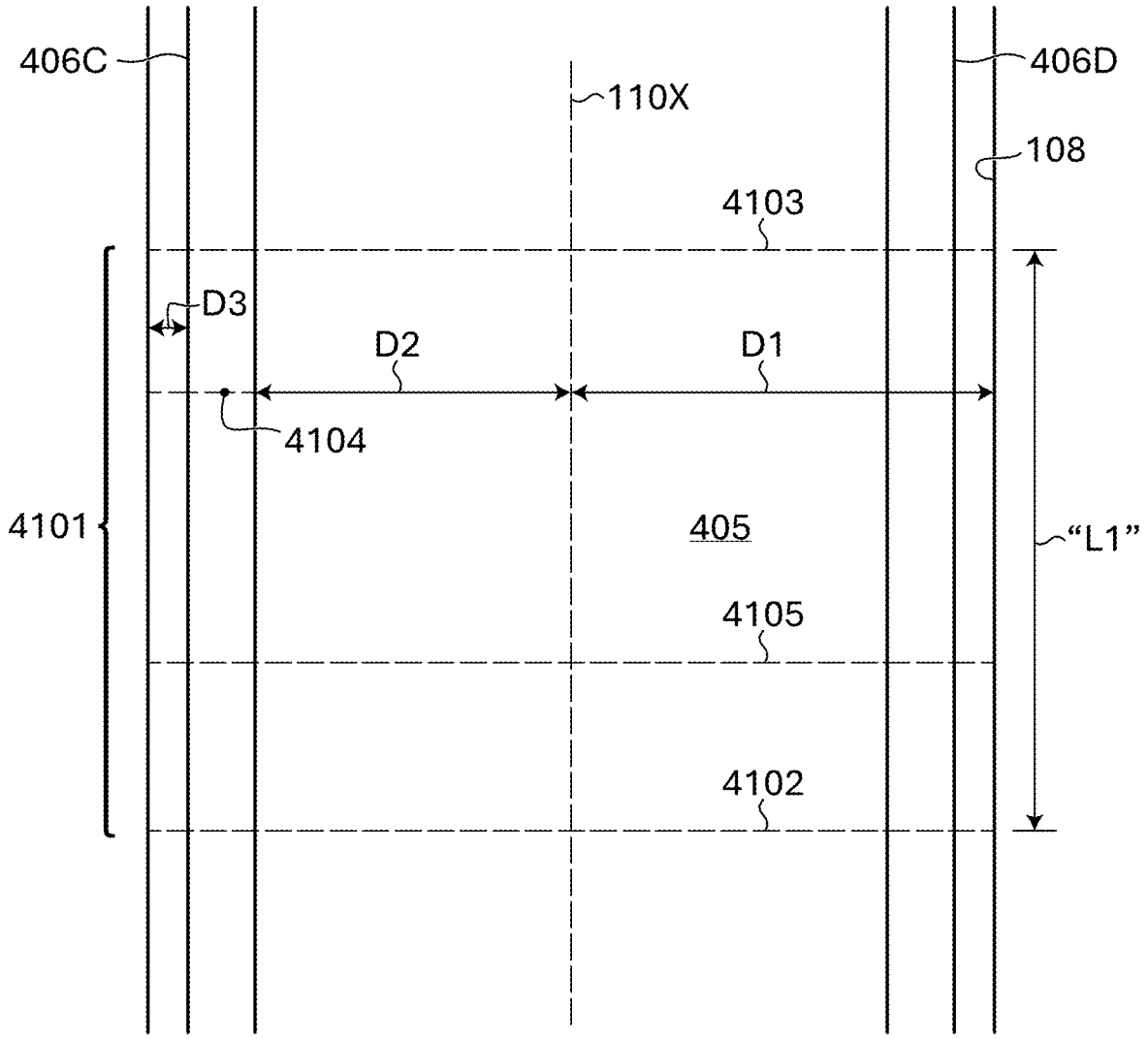
FIG. 4 is an enlargement of Detail "A" of FIG. 3.

Referring to FIG. 4, in some embodiments, for example, for each one of the eccentrically-disposed gas-depleted fluid conductor sections 406C, 406D, independently, and within a separation-promoting cross-section 4104 of the separation zone-defining wellbore string passage section 4101 of the wellbore string passage 110, the ratio of: (i) the minimum distance "D1", measured within the separation-promoting cross-section 4104, from the wellbore string 108 to the central longitudinal axis 110X of the wellbore string passage 110, to (ii) the minimum distance "D2", measured within the separation-promoting cross-section 4104, from the eccentrically-disposed fluid conductor section 406C (or 406D) to the central longitudinal axis 110X of the wellbore string passage 110, is greater than 1.15 to 1, such as, for example, greater than 1.2 to 1, such as, for example, greater than 1.23 to 1.

Referring again to FIG. 4, in some embodiments, for example, for each one of the eccentrically-disposed gas-depleted fluid conductor sections 406C, 406D, independently, the minimum distance "D3" from the eccentrically-disposed gas-depleted fluid conductor section to the wellbore string 108 is less than 0.75 inches, such as, for example, less than 0.5 inches, such as, for example, less than 0.25 inches.

Figure 5:
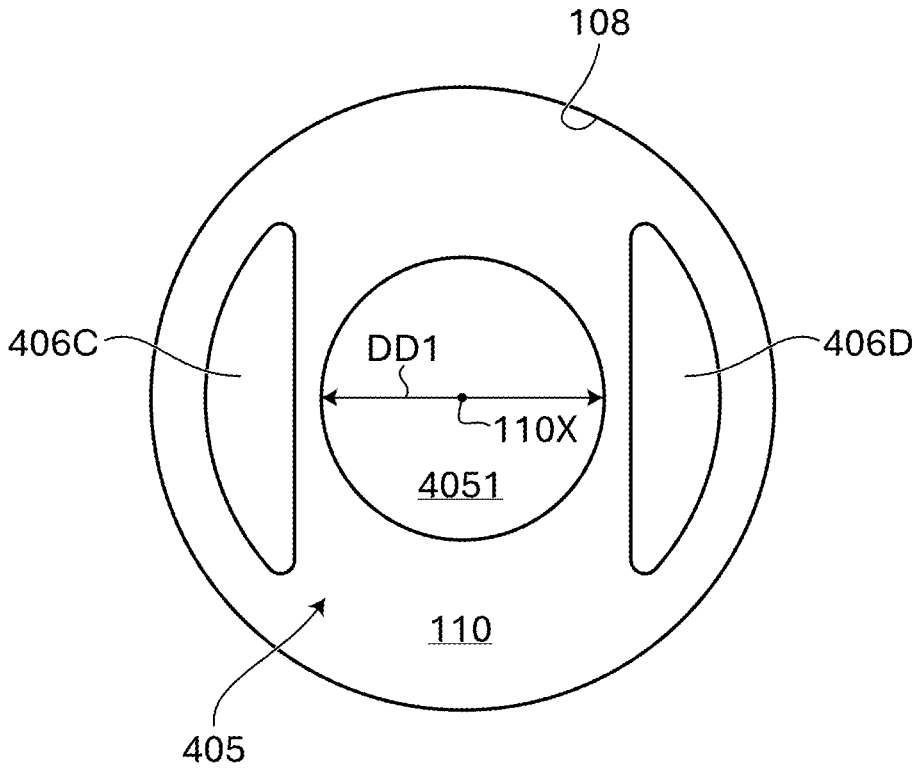
FIG. 5 is a plan view of a cross-section of an embodiment of the system of FIG. 1, and illustrating definition of the gas separation zone.

Referring to FIG. 5, in some embodiments, for example, for each one of the eccentrically-disposed gas-depleted fluid conductor sections 406C, 406D, independently, at least the portion of the eccentrically-disposed gas-depleted fluid conductor section that extends across the separation zone-defining wellbore passage section 4101 of the wellbore string passage 110, has a cross-sectional profile that is non-circular (e.g. oval-shaped). Configuring the eccentrically-disposed conductor section portion, such that its cross-sectional profile is non-circular, further mitigates interference with the separation, within the space 405, of the reservoir fluid into the gas-depleted reservoir fluid and the gas-enriched reservoir fluid, by the eccentrically-disposed gas-depleted fluid conductor sections 406C, 406D, and this mitigation is more pronounced where the cross-sectional profile of the eccentrically-disposed conductor section portion is oval-shaped and the cross-sectional profile of the wellbore string cross-section, traversed by the sections 406C, 406D, is circular.

Referring again to FIG. 5, in some embodiments, for example, within a separation-promoting cross-section 4105, of the wellbore string passage 110, extending through the separation zone 405, a space 4051 is defined within the separation zone 405, and the space 4051 occupies at least 70% (such as, for example, at least 80%) of the total cross-sectional area of the separation-promoting cross-section 4105. In some embodiments, for example, the central longitudinal axis 110X of wellbore string passage 110 extends through the space 4051. In some embodiments, for example, the space 4051 is circular and has a diameter "DD1" of at least one (1) inch (such as, for example, at least 1.5 inches, such as, for example, at least two (2) inches). In some embodiments, for example, the space 4051 is disposed laterally inwardly relative to the eccentrically-disposed conductor section configuration 406. In some embodiments, for example, the space 4051 is disposed laterally inwardly relative to the eccentrically-disposed conductor section configuration.

Figure 6:
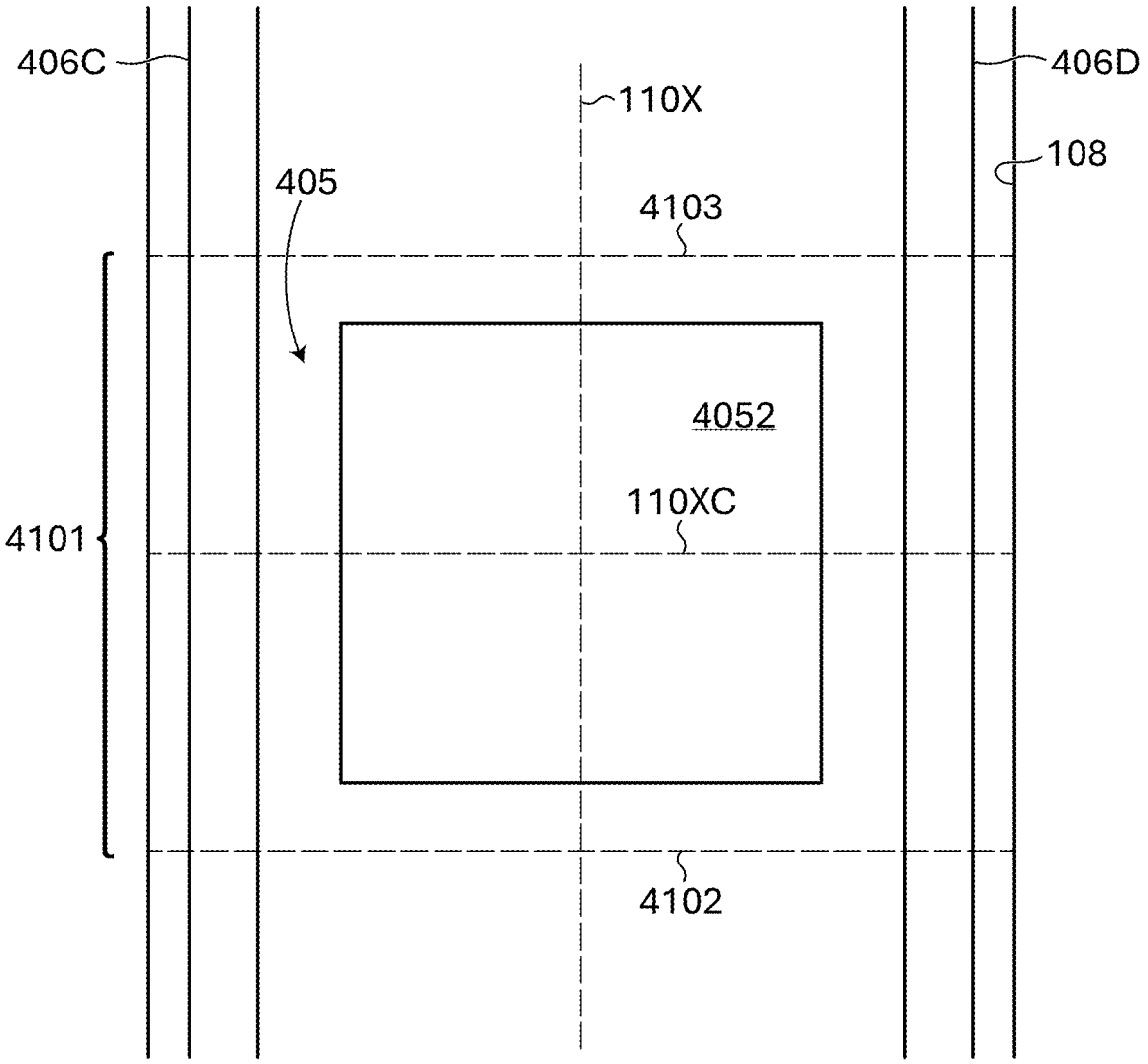
FIG. 6 is identical to FIG. 4, and further identifies features of the embodiment of the system of FIG. 1.
Figure 7:
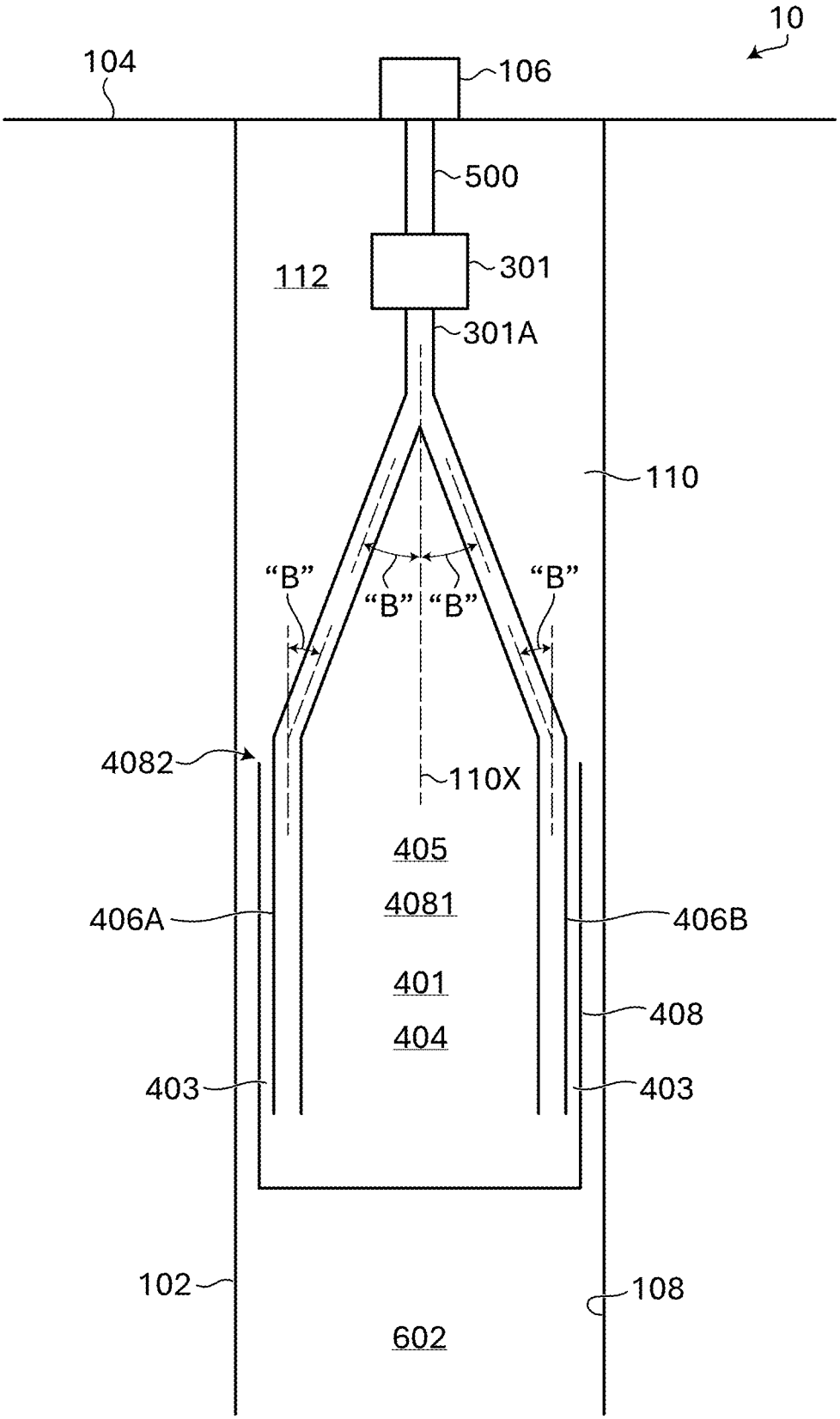
FIG. 7 is a schematic illustration of another embodiment of a system of the present disclosure.
Figure 8:
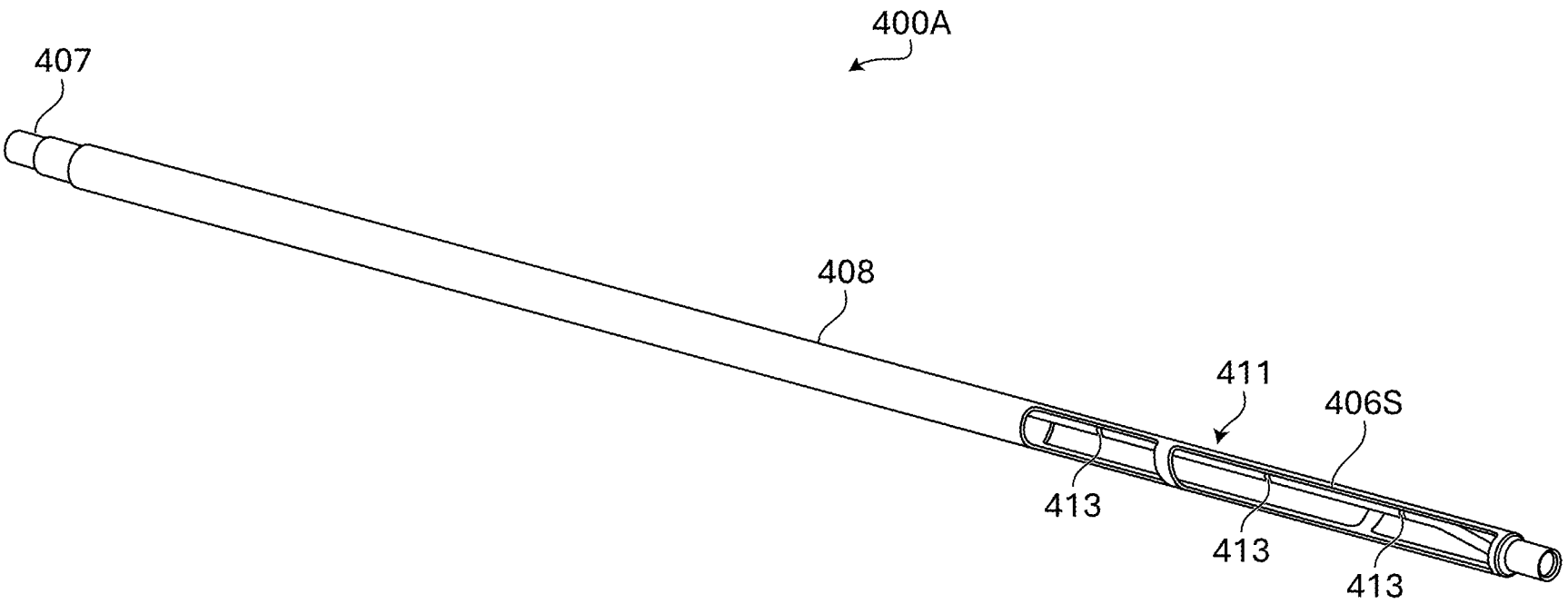
FIG. 8 is a schematic illustration of a top perspective view of another embodiment of a flow diverter of the present disclosure.
Figure 9:
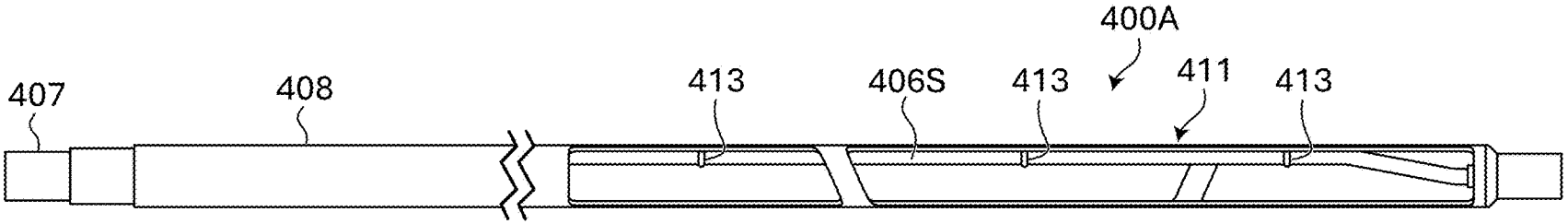
FIG. 9 is a schematic illustration of a side view of a first side of the flow diverter illustrated in FIG. 8.
Figure 10:
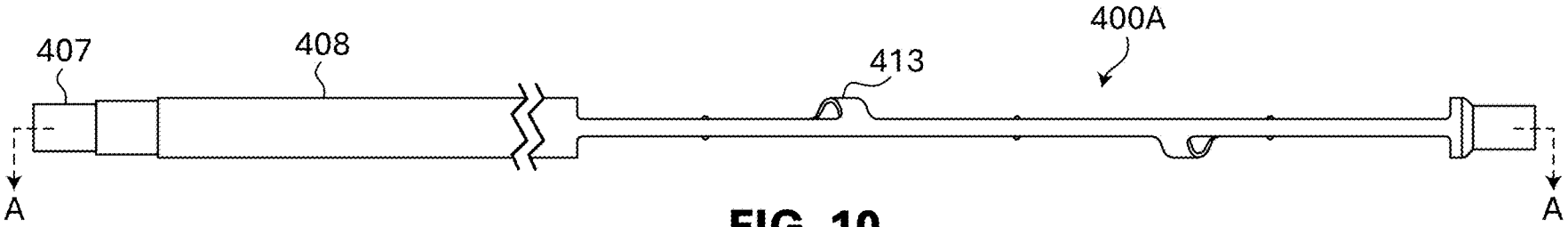
FIG. 10 is a schematic illustration of a side view of another side of the flow diverter illustrated in FIG. 8, with the flow diverter having been rotated 180 degrees about its central longitudinal axis relative to its position in FIG. 9.
Figure 11:
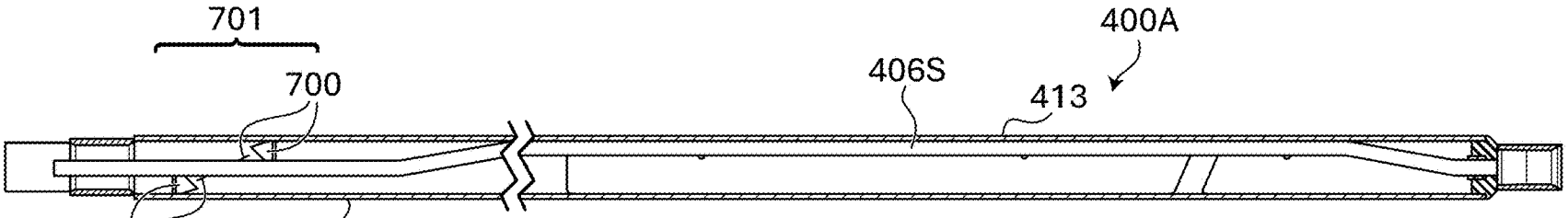
FIG. 11 is a schematic illustration of a sectional side view of the flow diverter illustrated in FIG. 8, taken along lines A-A in FIG. 10.
Figure 12:
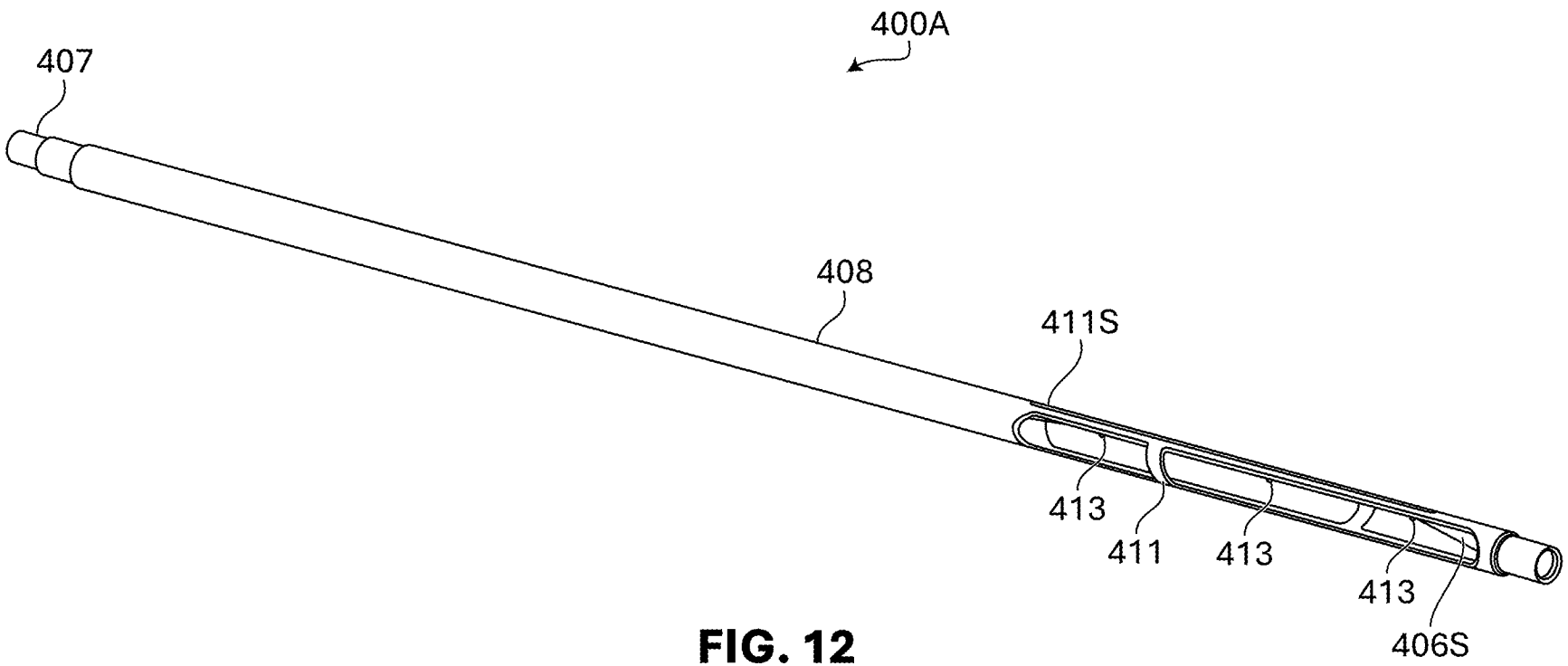
FIG. 12 is a schematic illustration of a top perspective view of another embodiment of a flow diverter of the present disclosure.
Figure 13:
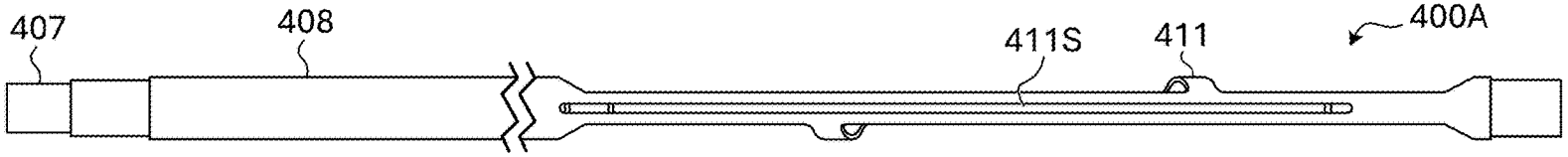
FIG. 13 is a schematic illustration of a side view of a first side of the flow diverter illustrated in FIG. 12.
Figure 14:
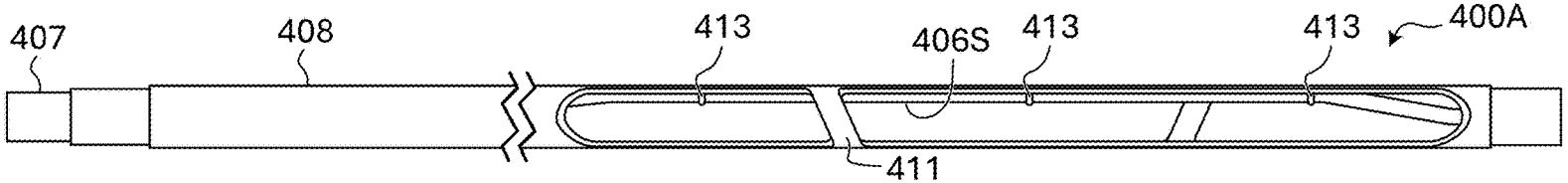
FIG. 14 is a schematic illustration of a side view of a second side of the flow diverter illustrated in FIG. 12, with the flow diverter having been rotated 90 degrees about its central longitudinal axis relative to its position in FIG. 13.
Figure 15:
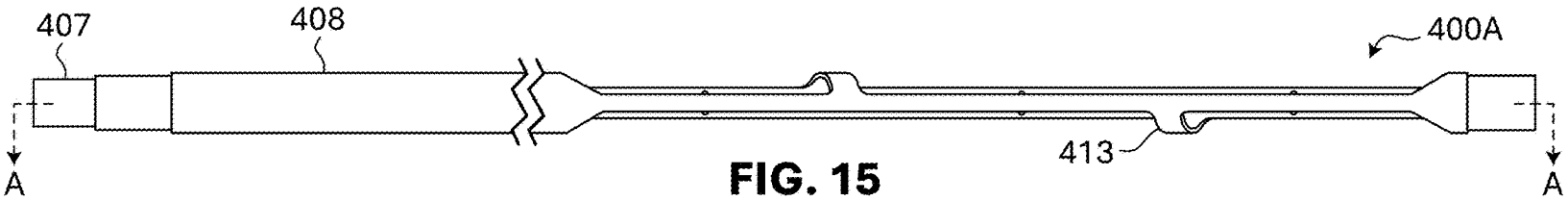
FIG. 15 is a schematic illustration of a side view of a third side of the flow diverter illustrated in FIG. 12, with the flow diverter having been rotated 180 degrees about its central longitudinal axis relative to its position in FIG. 13.

Referring to FIG. 6, in some embodiments, for example, a cylindrical space 4052 is defined within the separation zone 405. In some embodiments, for example, the central longitudinal axis 110X of wellbore string passage 110 extends through the cylindrical space 4052. In some embodiments, for example, the cylindrical space 4052 occupies at least 70% (such as, for example, at least 80%) of the total cross-sectional area of a cross-section 110XC of the wellbore string passage 110 which traverses the cylindrical space 4052. In some embodiments, for example, the cylindrical space 4052 has a diameter of at least one (1) inch (such as, for example, at least 1.5 inches, such as, for example, at least two (2) inches) and a height of at least one (1) foot (such as, for example, at least two (2) feet, such as, for example, at least three (3) feet, such as, for example, at least four (4) feet, such as, for example, at least five (5) feet, such as, for example, at least six (6) feet). In some embodiments, for example, the cylindrical space 4052 is disposed laterally inwardly relative to the eccentrically-disposed conductor section configuration.

In those embodiments where the flow diverting conductor configuration 406 includes the diverting conductor inlet configuration 4061 that is disposed in flow communication with the diverter inlet configuration 4081, in some of these embodiments, for example, each one of the flow diverting conductor branches 406A, 406B, independently, includes a respective branch inlet 4061A, 4061B in flow communication with the diverter inlet configuration 4081 for receiving reservoir fluid derived from the downwardly-flowing gas-depleted reservoir fluid being received by the diverter inlet configuration 4081, such that the diverting conductor inlet configuration 4061 is defined by the plurality of branch inlets 4061A, 4061B. In some of these embodiments, for example, for each one of the flow diverting conductor branches 406A, 406B, independently, the respective inlet 406AA, 406BB is disposed within the diverter cavity 401, such that, for each one of the flow diverting conductor branches 406A, 406B, independently, the flow diverting conductor branch 406A (406B), extends into the diverter cavity 401 such that a respective cavity-disposed portion 4062A (4062B) is disposed within the diverter cavity 401.

In some embodiments, for example, for each one of the flow diverting conductor branches 406A, 406B, independently, the branch inlet 4061A (or 4061B), respective to the flow diverting conductor branch, defines a respective inlet cross-sectional flow area, such that the cross-sectional flow area of the inlet configuration 4061 of the flow diverting conductor configuration 406 is defined by a sum of the plurality of cross-section flow areas of the plurality of branch inlets 4061A, 4061B. The ratio of: (i) the cross-sectional flow area of the collector inlet configuration 4081, to (ii) the cross-sectional flow area of the inlet configuration 4061 of the flow diverting conductor configuration 406 is greater than 8 to 1, such as, for example, greater than 10 to 1, such as, for example, greater than 12 to 1.

In those embodiments where the flow diverting conductor configuration 406 includes a plurality of flow diverting conductor branches 406A, 406B, relative to the configuration which is defined by a single flow diverting conductor only, and amongst other things, for the same total flowrate of gas-deplete reservoir fluid being conducted by the plurality of flow diverting conductor branches 406A, 406B, for each one of the branches 406A, 406B, the velocity of flow of the gas-depleted reservoir fluid being conducted by the branch is less than the velocity of flow of the gas-depleted reservoir fluid being conducted by the flow diverting conductor configuration 406 defined by a single flow diverting conductor only. As a result, erosion and corrosion phenomena is more pronounced for the flow diverting conductor configuration 406 which is defined by a single flow diverting conductor only versus the flow diverting conductor configuration 406 which includes a plurality of flow diverting conductor branches 406A, 406B.

Referring to FIGS. 8 to 21 in those embodiments where the flow diverting conductor configuration 406 is defined by a single flow diverting conductor 406S only, for mitigating erosion and corrosion phenomena, the single flow diverting conductor 406S defines a fluid passage-defining surface, through which the gas-depleted reservoir fluid is conducted, and the material of construction of the fluid passage-defining surface is relatively non-corrosive such as, for example, stainless steel. In such embodiments, the flow diverter 400 is a flow diverter 400A, which is mounted to the pump suction 301A. In some of these embodiments, for example, the relatively non-corrosive material is relatively weak, such that there is an absence of structural supporting of the flow diverter 400 by the flow diverting conductor configuration 406, and the structural supporting is effected by the pump suction 301A, as, in some embodiments, for example, the flow diverter 400A is hung from the pump suction 301A via a structural support configuration 411. In some embodiments, for example, the flow diverting conductor 406S is coupled to the structural support configuration 411 with clamps 413.

Figure 21:
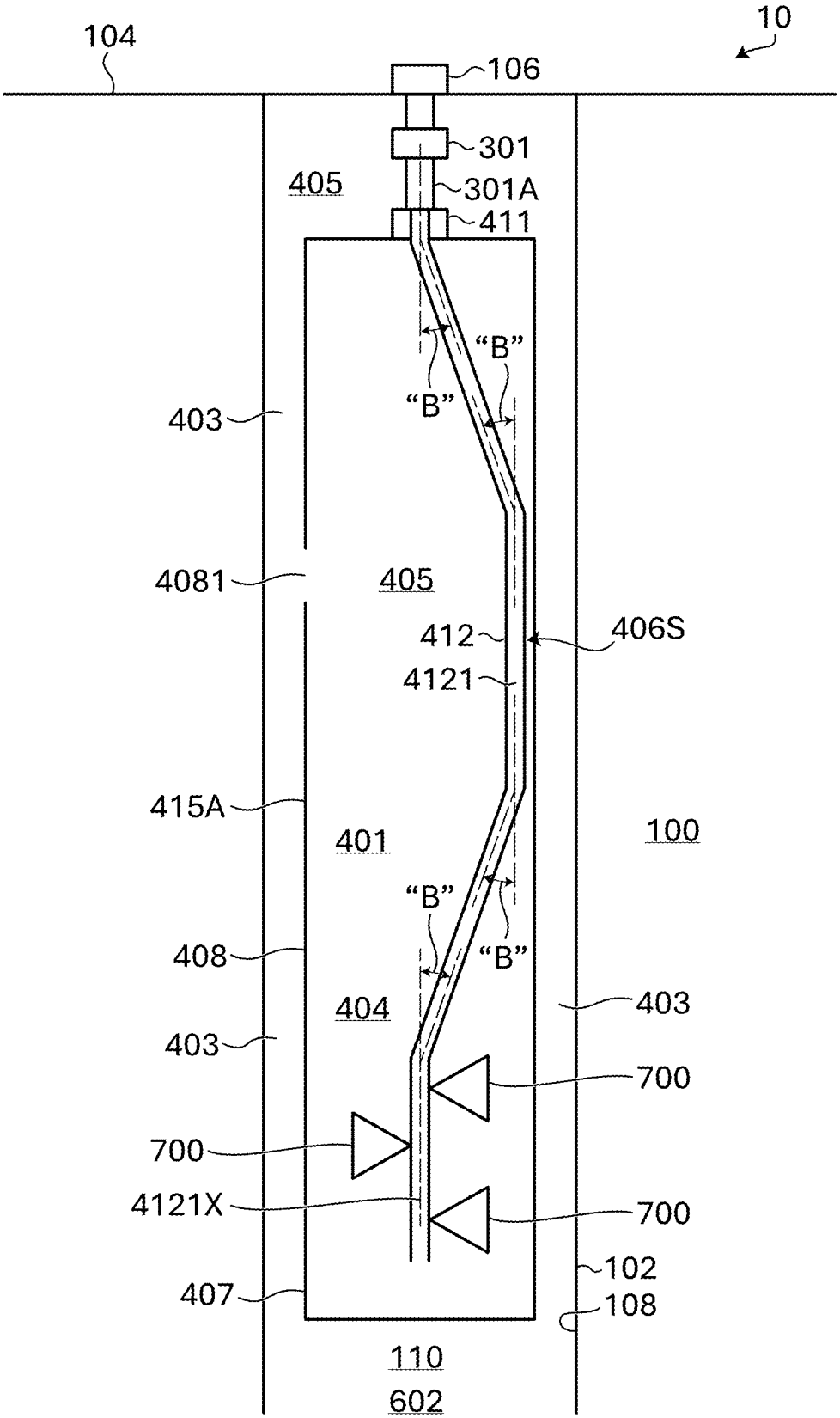
FIG. 21 is a schematic illustration of another embodiment of a system of the present disclosure.
Figure 22:
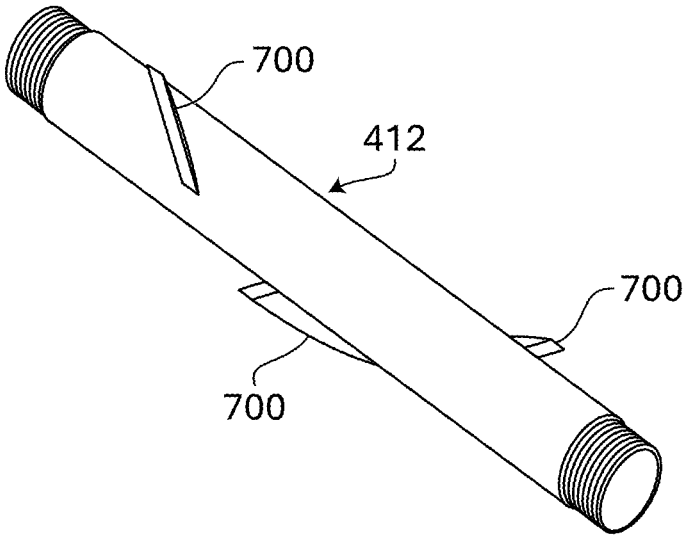
FIG. 22 is a schematic illustration of a top perspective view of a portion of a flow diverting configuration from which is extending a vane configuration.

Referring to FIGS. 8 to 20, in some embodiments, for example, the diverter inlet configuration 4081 is oriented in an uphole facing direction, and, in some of these embodiments, for example, the axis of the diverter inlet configuration 4081 is parallel to the central longitudinal axis 108X of the wellbore string 108. Referring to FIG. 21, in some embodiments, for example, the diverter inlet configuration 4081 is defined by one or more ports extending through a side wall 415A of the collector 408 at an upper portion of the collector 408. In some embodiments, for example, the diverter inlet configuration 4081 has an axis that is transverse to the central longitudinal axis 110X of the wellbore string passage 110. The diverter inlet configuration 4081 effects flow communication between the annular space 403 and the cavity 401 defined within the flow diverter 400A. In some embodiments, for example, the separation zone 405 is disposed externally of the flow diverter 400A, and above the diverter inlet configuration 4081, such that the diverter inlet configuration 4081 is disposed for receiving a downwardly-flowing gas-depleted fluid 708A from the externally-disposed separation zone 405. In some embodiments, for example, a portion of the separation zone 405 is disposed externally of the flow diverter 400A and above the diverter inlet configuration 4081, and another portion of the separation zone 405 is disposed within the cavity 401 of the flow diverter 400A, such that a fraction of the separation is effected externally of the flow diverter 400A and another fraction of the separation is effected within the cavity 401. In either case, a flow of the downwardly-flowing gas-depleted fluid 708A becomes established within the cavity 401. The downwardly-flowing gas-depleted reservoir fluid 708A then becomes diverted such that the gas-depleted reservoir fluid becomes conducted in an upwardly direction, by the single flow diverting conductor 406S. In some of these embodiments, for example, the flow diverter 400A is a "poor boy separator".

The upwardly-conducting gas-depleted reservoir fluid is conducted by the flow diverting conductor configuration 406 to the suction 301A of the pump 301. In this respect, the flow diverter 400 is fluidly coupled to the suction 301A of the pump 301. In some embodiments, for example, the fluid coupling between the separation zone 405 and the suction 301A of the pump 301 is effected by the flow diverting conductor configuration 406 only. To further mitigate erosion and corrosion phenomena, in some embodiments, for example, such as the embodiments illustrated in FIGS. 8 to 21, the flow diverting conductor configuration 406 is configured such that there is an absence of a bend, within the flow diverting conductor configuration 406, that has an angle "B" that is greater than ten (10) degrees.

Referring to FIGS. 8 to 22, in some embodiments, for example, the cavity-disposed portion 4062A of the flow diverting conductor 406S includes a flow passage-defining housing 412, defining a flow passage 4121, and a plurality of vanes 700, such that the flow diverting conductor 406S includes a vane configuration 701 disposed within the cavity 401. In some embodiments, for example, the vanes 700 are circumferentially staggered relative to one another. In some embodiments, for example, the vanes 700 are axially staggered relative to one another. In some embodiments, for example, each one of the vanes 700, independently, extends from the flow passage-defining housing 412, in a laterally outwardly direction relative to the central longitudinal axis 4121X of the flow passage 4121, by a minimum distance of at least one (1.0) inch, such as, for example, at least 1.5 inch. In some embodiments, for example, for each one of the vanes 700, independently, the vane is spaced apart from a closest one of the other ones of vanes by a minimum distance of at least two (2) inches.

In some of these embodiments, for example, the flow diverting conductor 406S and the collector 408 are co-operatively configured such that, while the gas-depleted reservoir fluid is being conducted, via the collection space 404, to the flow diverting conductor 406S, the gas-depleted reservoir fluid is conducted past the vane configuration 701 with effect that a torsional flow component is imparted to the conducted gas-depleted reservoir fluid by the vane configuration 701, such that separation of solid particulate material, from the gas-depleted reservoir fluid, is induced. In some embodiments, for example, the flow diverter 400 includes a mud joint 407 for collecting the separated solid particulate material.

Figure 16:
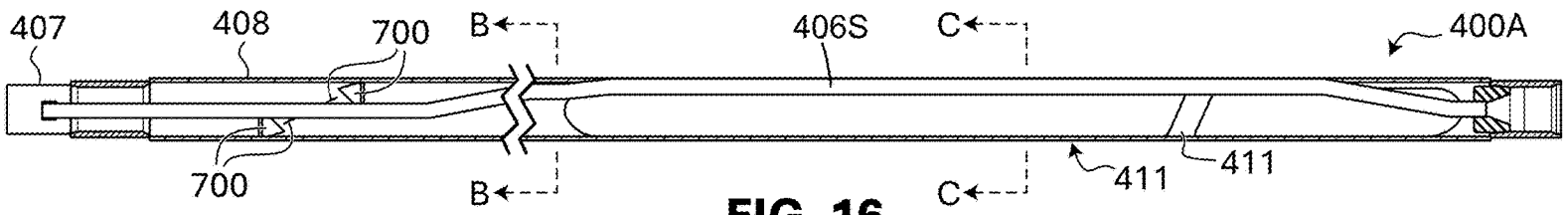
FIG. 16 is a schematic illustration of a sectional side view of the flow diverter illustrated in FIG. 12, taken along lines A-A in FIG. 15.
Figure 18:
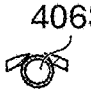
FIG. 18 is a schematic illustration of a view towards one end of the flow diverter illustrated in FIG. 12, taken along lines C-C in FIG. 16.
Figure 18:
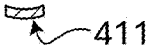
Figure 17:
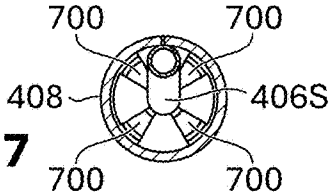
FIG. 17 is a schematic illustration of a view towards one end of the flow diverter illustrated in FIG. 12, taken along lines B-B in FIG. 16.
Figure 19:
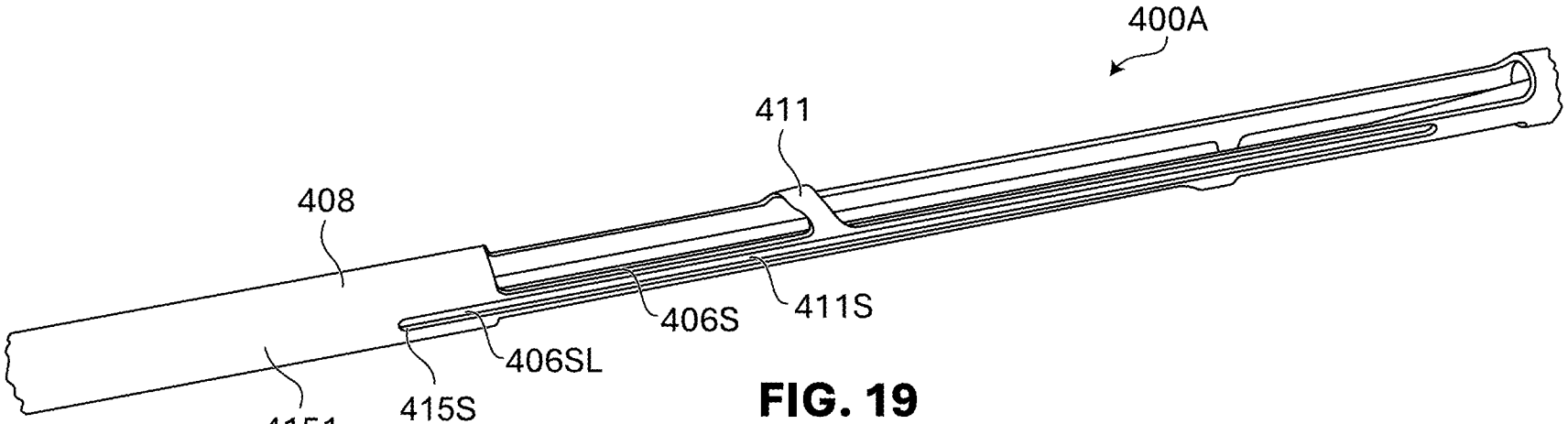
FIG. 19 is a schematic illustration of a view of one side of a portion of the flow diverter illustrated in FIG. 12.
Figure 20:
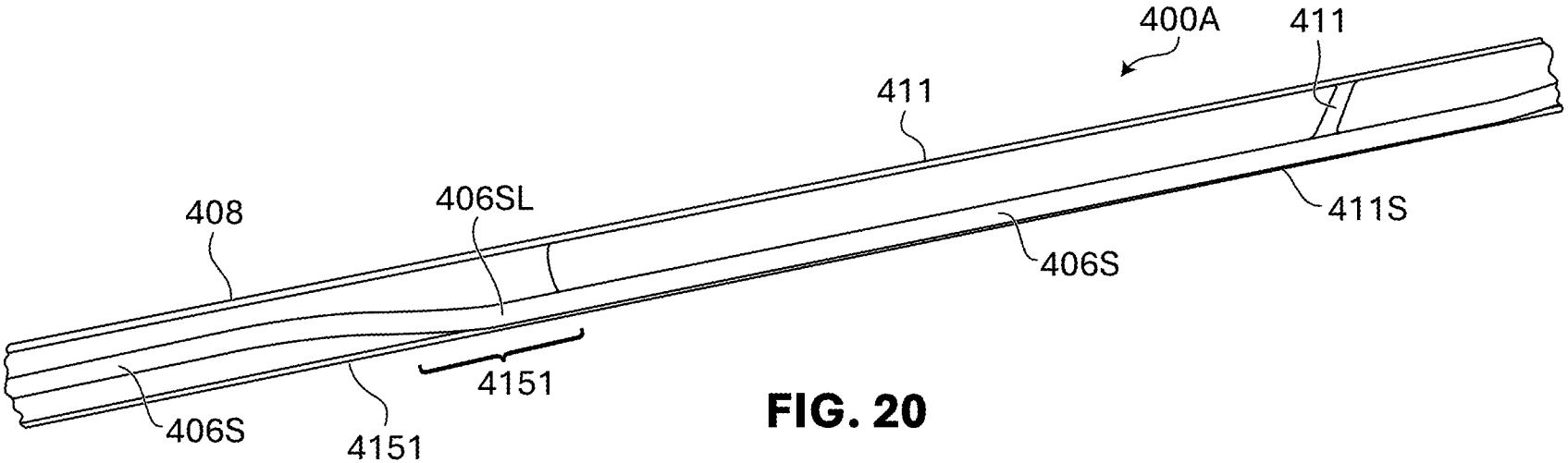
FIG. 20 is a schematic illustration of a sectional side view of a portion of the flow diverter illustrated in FIG. 12.

Referring to FIG. 16, in some embodiments, for example, at least one of the vanes 700, of the vane configuration 701, is disposed in contact engagement with the collector 408, with effect that the flow diverting conductor 406S is stabilized, such that vibration of the flow diverting conductor 406S is mitigated.

Referring to FIGS. 12 to 20, in some embodiments, for example, the continuous sidewall 415, of the collector 408, includes a slotted cylindrical portion 4151, defining a slot 415S, extending downwardly from an upper edge XXX of the collector 408, and within which is emplaced a lower portion 406SL of the flow diverting conductor 406S, such that the slot 415S is sealed by the lower portion 406SL of the flow diverting conductor 406S. In this respect, at least the slotted cylindrical portion 4151 and the lower portion 406SL, of the flow diverting conductor 406S, co-operate to define the sidewall 415. By adopting this configuration, the cross-sectional flow area, defined by the diverter inlet configuration 4081, is suitably enlarged to enhance the gas/liquid separation. Referring to Figures Relatedly, in some embodiments, for example, the structural support configuration 411 includes an elongated slot 411S through which the flow diverting conductor 406S extends so that the flow diverting conductor 406S is further spaced apart from the central longitudinal axis 108X of the wellbore string 108, and thereby increasing the space available for gas separation.

The pump 301 is effective for pressurizing the upwardly-flowing gas-depleted reservoir fluid flow 708B that is supplied to the suction 301A of the pump 301, with effect that the pressurized gas-depleted reservoir fluid flow 710 is discharged via the pump discharge 301B and received by the pressurized gas-depleted reservoir flow conductor 500, for flow to the surface via the pressurized gas-depleted reservoir flow conductor 500.

In this respect, the co-operation between the flow diverter 400 and the wellbore string 108 is effective for separating the gas-depleted reservoir fluid flow 708A from the reservoir fluid-derived fluid flow 704, and supplying the gas-depleted reservoir fluid flow 708B to the pump 301, for pressurizing the gas-depleted reservoir fluid flow 708B by the pump 301 for flow to the surface via the flow conductor 500.

In parallel, the gas-enriched reservoir fluid flow 706 is conducted upwardly to the surface 104 via a gas-enriched reservoir fluid-conducting passage 112 defined within the wellbore 102. In this respect, the gas-enriched reservoir fluid-conducting passage 112 is disposed uphole relative to, and in flow communication with, the separation zone 405.

The reservoir fluid produced from the subterranean formation 100, via the wellbore 102, including the gas-depleted reservoir fluid, the gas-enriched reservoir fluid, or both, may be discharged through the wellhead 106 to a collection facility, such as a storage tank within a battery.

In this respect, a fluid passage configuration 900 is defined within the wellbore 102, extending from the reservoir fluid-receiving zone 402 to the pump 301, for supplying the gas-depleted reservoir fluid flow 708B, derived from the reservoir fluid flow 702 received by the receiving zone 402, to the pump 301, for pressurization by the pump 301 for flow to the surface 104 as the flow 710 via the pressurized gas-depleted reservoir flow conductor 500. The fluid passage configuration 900 includes a fluid passage configuration portion defined by the upwardly-conducting reservoir fluid conductor configuration 403, the separation zone 405, and a fluid passage configuration portion defined by the flow diverting conductor configuration 406.

In the above description, for purposes of explanation, numerous details are set forth in order to provide a thorough understanding of the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. Therefore, it will be understood that certain adaptations and modifications of the described embodiments can be made and that the above discussed embodiments are considered to be illustrative and not restrictive. All references mentioned are hereby incorporated by reference in their entirety.

What is claimed is:

1. A system comprising a flow diverter, emplaced within a wellbore string passage of a wellbore string that is lining a wellbore through which reservoir fluid is producible from a hydrocarbon reservoir within a subterranean formation, wherein:

the flow diverter and the wellbore string are co-operatively configured such that, in response to inducement by a pump:

while reservoir fluid is disposed within a reservoir fluid-receiving zone, disposed within the wellbore string passage, the reservoir fluid is conducted upwardly to a gas separation zone disposed within the wellbore string passage, such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the flow diverter diverts the downwardly-flowing gas-depleted reservoir fluid such that the downwardly-flowing gas-depleted reservoir fluid changes direction and an upwardly-flowing gas-depleted reservoir fluid, being conducted by a flow diverting conductor configuration, is established, wherein the flow diverter includes the flow diverting conductor configuration;

wherein:

the flow diverting conductor configuration includes a plurality of flow diverting conductor branches, wherein:

each one of the flow diverting conductor branches, independently, includes a respective branch inlet configuration, defined by at least one port, in flow communication with the gas separation zone, with effect that the established upwardly-flowing gas-depleted reservoir fluid is distributed amongst the flow diverting conductor branches, such that:

the plurality of flow diverting conductor branches defines a plurality of branch inlet configurations; and for each one of the flow diverting conductor branches, a portion of the upwardly-flowing gas-depleted reservoir fluid is established within the flow diverting conductor branch.

2. The system as claimed in claim 1;

wherein:

the established upwardly-flowing gas-depleted reservoir fluid, being conducted by the flow diverting conductor configuration, is emplaced above the separation zone.

3. The system as claimed in claim 1;

wherein:

the flow diverter includes:

a diverter inlet configuration, defined by at least one port; and a diverter cavity;

for each one of the flow diverting conductor branches, independently, the flow communication, between the respective branch inlet configuration and the gas separation zone, is effected via the diverter inlet configuration only.

4. The system as claimed in claim 3;

wherein:

each one of the flow diverting conductor branches, independently, extends into the diverter cavity such that, for each one of the flow diverting conductor branches, independently, the respective branch inlet configuration is disposed within the diverter cavity.

5. The system as claimed in claim 4;

wherein:

the established upwardly-flowing gas-depleted reservoir fluid, being conducted by the flow diverting conductor configuration, is emplaced above the diverter inlet configuration.

6. The system as claimed in claim 5;
wherein:
the established upwardly-flowing gas-depleted reservoir fluid, being conducted by the flow diverting conductor configuration, is emplaced above the separation zone.

7. The system as claimed in claim 4;
wherein:
the flow diverting conductor configuration defines a diverting conductor inlet configuration that is defined by the plurality of branch inlet configurations;
each one of the branch inlet configurations, independently, defines a respective branch inlet configuration cross-sectional flow area, such that a total cross-sectional flow area of the diverting conductor inlet configuration is defined by a sum of the plurality of cross-section flow areas of the plurality of branch inlet configurations;
the ratio of: (i) a total cross-sectional flow area of the diverter inlet configuration, to (ii) the total cross-sectional flow area of the diverting conductor inlet configuration is greater than 8 to 1.

8. The system as claimed in claim 1;
wherein:
the separation zone extends from a lower wellbore string passage cross-section, of the wellbore string passage, to an upper wellbore string passage cross-section, of the wellbore string passage, such that a separation zone-defining wellbore string passage section, of the wellbore string passage, is defined and extends from the lower wellbore string passage cross-section to the upper wellbore string passage cross-section, wherein the upper wellbore string passage cross-section is disposed above the lower wellbore string passage cross-section;
for each one of the flow diverting branches, independently, at least a portion of the flow diverting conductor branch is defined by a respective eccentrically-disposed flow diverting conductor section, such that a plurality of eccentrically-disposed flow diverting conductor sections is defined and establishes an eccentrically-disposed gas-depleted fluid conductor configuration; and
each one of the eccentrically-disposed gas-depleted fluid conductor sections, independently, is disposed eccentrically relative to the central longitudinal axis of the wellbore string passage and extends at least across the separation zone-defining wellbore passage section.

9. The system as claimed in claim 8;
wherein:
each one of eccentrically-disposed flow diverting conductor sections, independently, has a total length "L1" of at least three (3) feet, as measured along the central longitudinal axis of the eccentrically-disposed flow diverting conductor section.

10. The system as claimed in claim 8;
wherein:
for each one of the eccentrically-disposed fluid flow-diverting conductor sections, independently, a minimum distance "D3" from the eccentrically-disposed gas-depleted fluid conductor section to the wellbore string is less than 0.75 inches.

11. The system as claimed in claim 8;
wherein:
within a separation-promoting cross-section, of the separation zone-defining wellbore string passage section, a space is defined within the separation zone, and the space occupies at least 70% of the total cross-sectional area of the separation-promoting cross-section.

12. The system as claimed in claim 11;
wherein:
the space is a circular space and has a diameter of at least one (1) inch.

13. The system as claimed in claim 11;
wherein:
for each one of the eccentrically-disposed flow diverting conductor sections, independently, and within the separation-promoting cross-section, the ratio of: (i) a minimum distance "D1", measured within the separation-promoting cross-section, from the wellbore string to the central longitudinal axis of the wellbore string passage, to (ii) a minimum distance "D2", measured within the separation-promoting cross-section, from the eccentrically-disposed flow diverting conductor section to the central longitudinal axis of the wellbore string passage, is greater than 1.2 to 1.

14. The system as claimed in claim 8;
wherein:
for each one of the eccentrically-disposed flow diverting conductor sections, independently, and within a separation-promoting cross-section of the separation zone-defining wellbore string passage section, the ratio of: (i) a minimum distance "D1", measured within the separation-promoting cross-section, from the wellbore string to the central longitudinal axis of the wellbore string passage, to (ii) a minimum distance "D2", measured within the separation-promoting cross-section, from the eccentrically-disposed flow diverting conductor section to the central longitudinal axis of the wellbore string passage, is greater than 1.2 to 1.

15. The system as claimed in claim 1;
wherein:
the emplacement of the reservoir fluid within the gas separation zone is such that the gas separation zone is occupied by reservoir fluid only.

16. The system as claimed in claim 1;
wherein:
there is an absence of occupation of the gas separation zone by a downhole completion.

17. The system as claimed in claim 1;
wherein:
the flow diverter and the wellbore string are co-operatively configured such that an annular space is established between the flow diverter and the wellbore string for conducting the reservoir fluid from the reservoir fluid-receiving zone to the separation zone.

18. A system for producing reservoir fluid from a hydrocarbon reservoir within a subterranean formation via a wellbore string passage of a wellbore string that is lining a wellbore that is extending into the subterranean formation, comprising:
a pump; and
a flow diverter, emplaced within the wellbore string passage, including:
a diverter inlet configuration, defined by at least one port;

a diverter cavity; and a flow diverting conductor configuration defining a flow passage configuration;

wherein:

fluid coupling between the diverter cavity and the suction of the pump is effected via the flow passage configuration of the flow diverting conductor configuration only;

the flow diverter and the wellbore string are co-operatively configured such that, in response to inducement by the pump:

while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the diverter cavity receives the downwardly-flowing gas-depleted reservoir fluid, via the diverter inlet configuration, with effect that the downwardly-flowing gas-depleted reservoir fluid becomes disposed within the diverter cavity; and the flow diverter diverts the received downwardly-flowing gas-depleted reservoir fluid such that the downwardly-flowing gas-depleted reservoir fluid changes direction and an upwardly-flowing gas-depleted reservoir fluid, being conducted by the flow diverting conductor configuration, is established, and supplied to the pump;

wherein:

there is an absence of alignment between a central longitudinal axis, of a portion of the flow passage configuration of the flow diverting conductor configuration, with a central longitudinal axis of a flow passage of a pump suction of the pump; and there is an absence of a bend, within the flow passage configuration of the flow diverting conductor configuration, that is greater than ten (10) degrees.

19. The system as claimed in claim 18;

wherein:

the flow communication between the flow passage configuration and the gas separation zone is effected via the diverter inlet configuration only and the flow diverting conductor configuration defines a diverting conductor inlet configuration, defined by at least one port; and the diverting conductor inlet configuration, of the flow diverting conductor configuration, defines a respective inlet cross-sectional flow area; and the ratio of: (i) the cross-sectional flow area of the diverter inlet configuration, to (ii) the cross-sectional flow area of the diverting conductor inlet configuration, of the flow diverting conductor configuration, is greater than 8 to 1.

20. The system as claimed in claim 19;

wherein:

the flow diverter conductor configuration is defined by a single fluid conductor, such that the flow passage configuration is defined by a single flow passage.

21. A system for producing reservoir fluid from a hydrocarbon reservoir within a subterranean formation via a wellbore string passage of a wellbore string that is lining a wellbore that is extending into the subterranean formation, comprising:

a flow diverter, emplaced within the wellbore string passage, including:

a cavity-defining housing;

a cavity defined within the cavity-defining housing; and a flow diverting conductor extending into the cavity such that a cavity-disposed portion of the flow diverting conductor is disposed within the cavity;

wherein:

the cavity-disposed portion of the flow diverting conductor includes:

a flow passage-defining housing which defines a flow passage; and a plurality of vanes, such that the flow diverting conductor includes a vane configuration disposed within the cavity;

wherein:

each one of the vanes, independently, extends from the flow passage-defining housing, in a laterally outwardly direction relative to the central longitudinal axis of the flow passage;

the flow diverter and the wellbore string are co-operatively configured such that, in response to inducement by a pump:

while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the cavity receives the downwardly-flowing gas-depleted reservoir fluid with effect that the downwardly-flowing gas-depleted reservoir fluid is conducted past the vane configuration with effect that a torsional flow component is imparted to the downwardly-flowing gas-depleted reservoir fluid by the vane configuration, such that separation of solid particulate material, from the downwardly-flowing gas-depleted reservoir fluid, is induced; and the flow diverter diverts the downwardly-flowing gas-depleted reservoir fluid such that the downwardly-flowing gas-depleted reservoir fluid changes direction and an upwardly-flowing gas-depleted reservoir fluid, being conducted by the flow diverting conductor, is established; and relative to one another, the vanes are circumferentially staggered and axially staggered.

22. The system as claimed in claim 21;

wherein:

for each one of the vanes, independently, the vane extends from the flow passage-defining housing, in a laterally outwardly direction relative to the central longitudinal axis of the flow passage, by a minimum distance of at least one (1.0) inch.

23. The system as claimed in claim 21;

wherein:

at least one of the vanes, of the vane configuration, is disposed in contact engagement with the cavity-defining housing.

24. A system for producing reservoir fluid from a hydrocarbon reservoir within a subterranean formation via a wellbore string passage of a wellbore string that is lining a wellbore that is extending into the subterranean formation, comprising:

a flow diverter, emplaced within the wellbore string passage, including:

a housing, wherein the housing includes a base and a continuous sidewall, extending upwardly from the base, and the base and the continuous sidewall co-operate to define the cavity;

a flow diverting conductor;

wherein:

the flow diverter and the wellbore string are co-operatively configured such that, in response to inducement by a pump:

while reservoir fluid is disposed within a reservoir fluid-receiving zone, disposed within the wellbore string passage, the reservoir fluid is conducted upwardly to a gas separation zone, disposed within the wellbore string passage such that the reservoir fluid becomes emplaced within the gas separation zone, with effect that the reservoir fluid flow is separated into at least a downwardly-flowing gas-depleted reservoir fluid and an upwardly flowing gas-enriched reservoir fluid, wherein the separation includes separation in response to buoyancy forces within the gas separation zone; and while the separated gas-depleted reservoir fluid is flowing downwardly from the separation zone, the cavity receives the downwardly-flowing gas-depleted reservoir fluid with effect that the downwardly-flowing gas-depleted reservoir fluid is conducted past the vane configuration with effect that a torsional flow component is imparted to the downwardly-flowing gas-depleted reservoir fluid by the vane configuration, such that separation of solid particulate material, from the downwardly-flowing gas-depleted reservoir fluid, is induced; and the flow diverter diverts the downwardly-flowing gas-depleted reservoir fluid such that the downwardly-flowing gas-depleted reservoir fluid changes direction and an upwardly-flowing gas-depleted reservoir fluid, being conducted by the flow diverting conductor, is established;

and the continuous sidewall, of the housing, includes a slotted cylindrical portion, defining a slot extending downwardly from an upper edge of the housing, and within which is emplaced a lower portion of the flow diverting conductor, such that the slot is sealed by the lower portion of the flow diverting conductor, and such that at least the slotted cylindrical portion and the lower portion, of the flow diverting conductor, co-operate to define the sidewall.

* * * * *